United States Patent [19]

Leinoff et al.

[11] Patent Number: 4,823,569

[45] Date of Patent: Apr. 25, 1989

[54] CLOTHING LOCK

[76] Inventors: David Leinoff, 71 Park Ave., New York, N.Y. 10016; Louis Puglisi, P.O. Box 199, Little Neck, N.Y. 11362

[21] Appl. No.: 91,260

[22] Filed: Aug. 28, 1987

[51] Int. Cl.[4] ..... E05B 69/00

[52] U.S. Cl. ..... 70/59; 70/57; 70/60; 70/62; 211/4; 211/7; 248/551

[58] Field of Search ..... 70/57–60, 70/62, 14–19; 211/4, 7, 123; 248/551

[56] References Cited

U.S. PATENT DOCUMENTS

| | | | |
|---|---|---|---|
| 3,438,506 | 4/1969 | Groth | 70/62 X |
| 3,659,721 | 5/1972 | Parillo | 211/7 |
| 3,690,130 | 9/1972 | Eutzler | 70/59 X |
| 3,735,875 | 5/1973 | Parillo | 211/7 |
| 3,798,934 | 3/1974 | Wright | 70/49 X |
| 3,985,183 | 10/1976 | Fernbaugh | 70/58 X |
| 4,069,919 | 1/1978 | Fernbaugh | 70/62 X |
| 4,260,063 | 4/1981 | Bennett | 211/4 |
| 4,390,099 | 6/1983 | Trautlein et al. | 211/4 |
| 4,460,093 | 7/1984 | Otema | 70/59 X |
| 4,573,584 | 3/1986 | Otema | 70/59 X |
| 4,598,827 | 7/1986 | Keifer | 70/59 X |
| 4,676,080 | 6/1987 | Schwarz | 70/59 |
| 4,683,730 | 8/1987 | Lee | 70/59 |
| 4,685,572 | 8/1987 | Jamison | 70/59 X |
| 4,696,405 | 9/1987 | Waring | 211/4 |

FOREIGN PATENT DOCUMENTS

| | | | |
|---|---|---|---|
| 362847 | 11/1922 | Fed. Rep. of Germany | 211/4 |
| 2446094 | 9/1980 | France | 211/7 |
| 398358 | 3/1966 | Switzerland | 70/14 |

*Primary Examiner*—Gary L. Smith
*Assistant Examiner*—Suzanne L. Dino
*Attorney, Agent, or Firm*—Pasquale A. Razzano

[57] ABSTRACT

A clothing lock or security device having a base or block from which a flexible cable extends. The cable has a free end which is formed as a stiff metal pin with a catch recess formed therein for forming the shaft of the lock in the base. This lock can be placed in a fur coat or other garment, with the needle portion piercing the garment and then being wrapped around a pole or the like, and then repiercing the garment for engagement in the block. This block is used in conjunction with a double bar coat rack having a plurality of inverted T-shaped sections extending downwardly from the top rack. The inverted T-shaped sections are movable between an open position wherein the garment secured by the clothing lock may be inserted onto and removed from a horizontal support rack formed therein, and a closed position, wherein the garments are secured along the horizontal bottom rack.

6 Claims, 2 Drawing Sheets

CLOTHING LOCK

BACKGROUND OF THE INVENTION

The present invention relates to a clothing lock or security device to prevent pilfering of displayed garments, and more particularly, relates to a security guard system for securing expensive garments, such as furs, along a coat rack. The present invention permits the garments to be displayed on conventional hangers while at the same time prevents the garments from being removed from the rack unwantedly.

In the retail industry, it is customary to display garments on conventional hangers which are mounted on long racks such that the potential consumer may view the garments, and, if desirable, remove the garment from the rack and try it on. Since the pilfering of these products has become an ever increasing serious problem, numerous security devices for garments have surfaced. This is especially critical when a merchant is selling expensive garments. In almost every case these security devices have been permanent installations in which a chain or cable is fixed to a support stand or rack of special construction.

In order to secure expensive garments, such as furs, the retailer is also concerned that the security device will not damage the garment. It is therefore desirable to provide a security device which is not only economical to manufacture and easy to use but also to provide a security device which will not damage the garment.

In addition, because of the great value of certain garments, like fur coats, it is desirable that some security device be permanently installed in the garment so that the purchaser can use it when storing the garment at a restaurant or the like.

OBJECTS OF THE INVENTION

It is a general object of the present invention to provide a clothing lock or security device which prevents pilfering of garments.

It is also an object of the present invention to provide a security device for expensive garments, such as furs, which will not damage the garment.

It is a further object of the present invention to provide a security device in which a locking cable has a needle formed at its end which serves a dual purpose of a penetrating needle through the garment as well as a lock element.

It is yet a further object of the present invention to provide a double bar coat rack, one bar of which includes sections which may be moved or rotated between opened and closed positions such that the garment with the security device disclosed therein may be removed from the rack or securely mounted onto the rack.

It is still a further object of the present invention to provide a security device and double bar coat rack assembly which is easy to use, relatively simple in construction and inexpensive to manufacture.

Various other objects, advantages and features of the present invention will become readily apparent from the ensuing detailed description and the novel features will be particularly pointed out in the appended claims.

SUMMARY OF THE INVENTION

In accordance with one of the general objects of the present invention, a clothing lock or garment security device is provided which prevents pilfering of displayed garments. The security device of the present invention includes a base or block from which a flexible cable extends. The cable has a free end which is formed as a stiff metal pin with a catch recess formed therein for forming the shaft of a lock in the base. This lock is placed in a fur coat, or other garment, with the aid of the needle which pierces the garment and can be wrapped around a pole or the like, and then engaged with the lock or base.

The lock of the present invention is also adapted for use in conjunction with the double bar coat rack of the present invention. The clothing lock as aforedescribed is placed in the garment with the needle piercing the garment from the interior to the exterior and back again. The cable can then be wrapped around the pole or garment hanger and then engaged in the lock. The pole or bar over which the cable of the lock is wrapped may include, in accordance with another aspect of the invention, inverted T-shaped sections which are movable or rotatable between opened and closed positions. In the open position of the inverted T-shaped section, the cable of the lock can pass through the opening created thereby and can be inserted into or removed from the pole. When adjacent inverted T-shaped sections are in their closed positions, the garments retained between vertical members of those sections are securely mounted on the pole.

BRIEF DESCRIPTION OF THE DRAWINGS

The following detailed description, given by way of example, and not intended to limit the present invention solely to the embodiment shown herein, may best be understood in conjunction with the accompanying drawings in which.

DESCRIPTION OF THE PREFERRED EMBODIMENT

Figure 1:
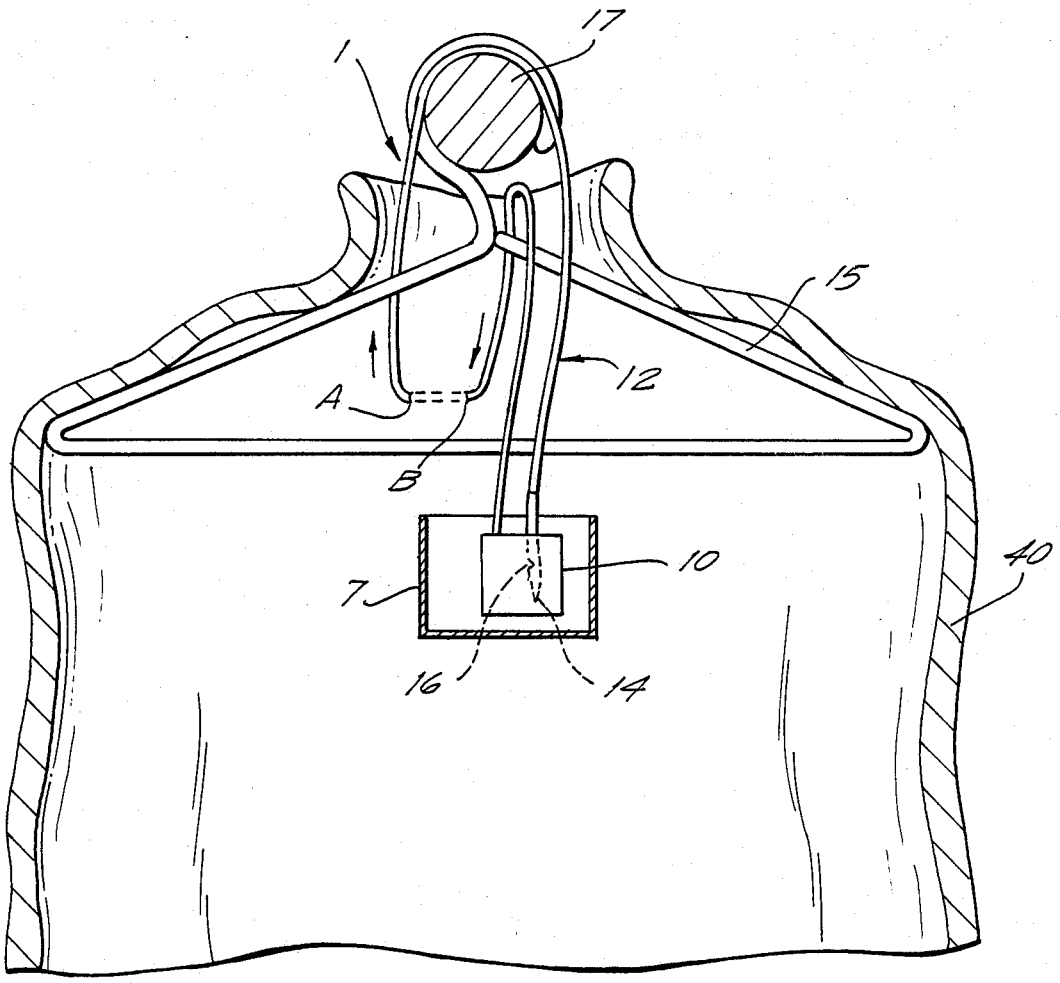
FIG. 1 is a front elevational view of the security device of the present invention.

Referring now to the drawings in detail, and initially, to FIG. 1 thereof, it will be seen that a security device or clothing lock 1 constructed in accordance with the present invention is illustrated. The clothing lock or garment security device includes a base or block 10 from which a flexible cable 12 extends. The cable has a free end 14 which is formed as a stiff metal pin with a catch recess 16 formed therein forming the shaft of the lock (similar to the shaft or hasp of a padlock) in the base 10.

As a result of the construction of this clothing lock 1, the lock can be placed in a fur coat, or other garment, with the needle 14 piercing the garment from the inside to the out, at point A and then back in again at point B. In this way the lock 1 is securely held in the garment and the cable can be wrapped around a pole 17 or the like which can also support a conventional hanger 15 on which the garment is hung.

Preferably the lock 1 is of conventional construction but very thin. It may be monogrammed on its surface for decorative effect. Alternatively, a pocket 7 can be sewn into the lining of the coat where the lock (and the cable when not in use) can be stored.

Figure 2:
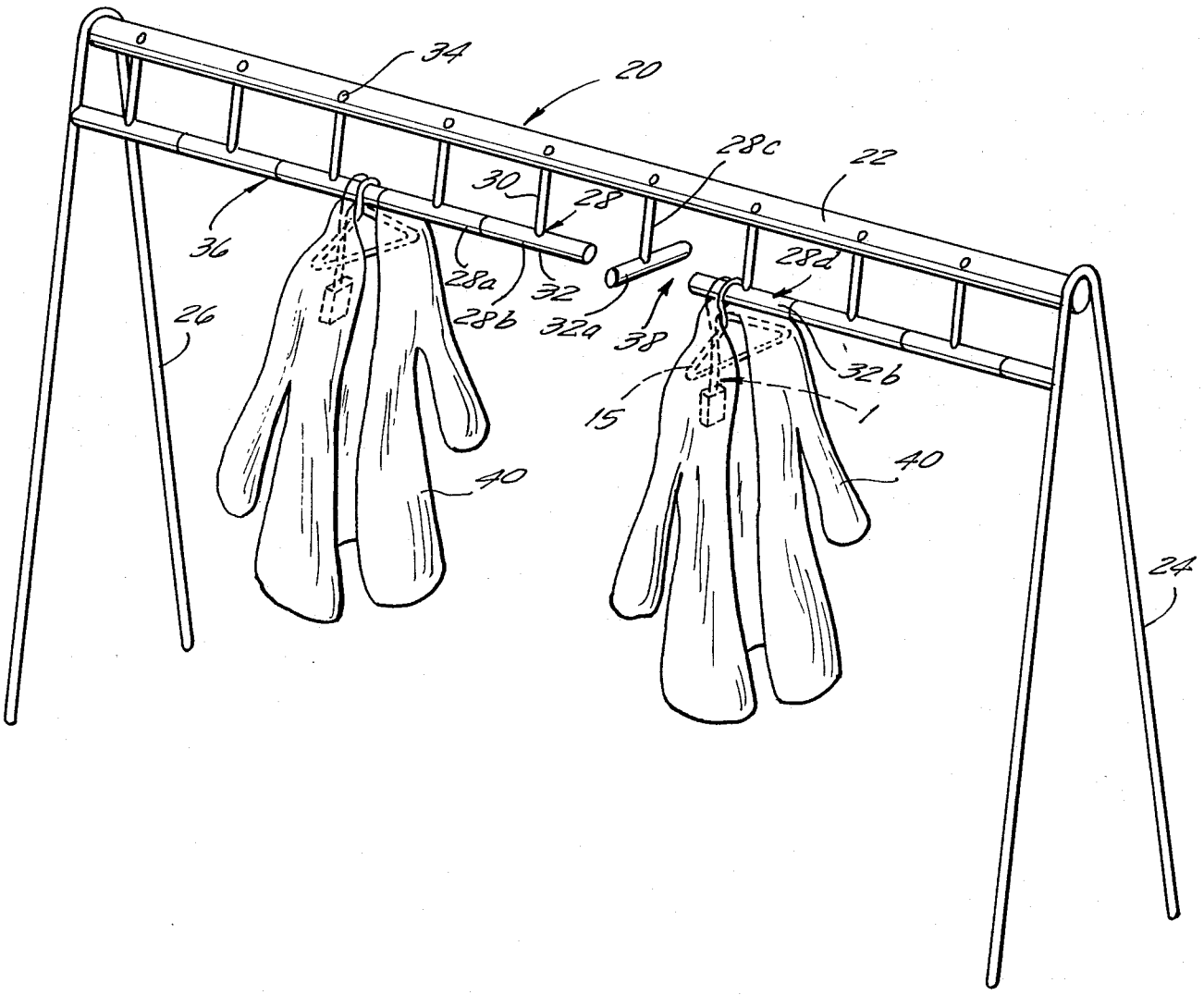
FIG. 2 is a front perspective view of a security display rack constructed in accordance with the present invention.

As shown in FIG. 2, the construction of the security device permits its use in conjunction with a novel double bar coat rack 20. Double bar coat rack 20 includes a fixed or stationary top rack 22 which is supported relative to a ground surface by inverted V-shaped side support members 24 and 26, or the like.

In order to removably secure the garments along the double bar coat rack, a plurality of inverted T-shaped sections 28 extend downwardly from top rack 22. Each inverted T-shaped section 28 includes a vertical member 30 and a horizontal member 32. The vertical member 30 of each T-shaped section is rotatably mounted on top rack 22. A lock 34 of conventional construction is positioned along top rack 22 which permits the operator to lock each T-shaped section in the position in which sections 32 thereof are aligned. These locking arrangements will be apparent to those skilled in the art.

Each inverted T-shaped section is movable between an opened and a closed position. If adjacent inverted T-shaped sections are in their closed positions, the horizontal members 32 form a horizontal bottom rack 36 of double bar coat rack 20 on which garments may be engagably mounted and secured. In this closed position, the garment is restrained from lateral movement by the adjacent vertical members 30 of complementary inverted T-shaped sections, such as 28*a* and 28*b*. If one of the inverted T-shaped sections is moved to its open position, the horizontal member 32*a* of that T-shaped section 28*c* is angularly displaced from the horizontal members of an adjacent T-shaped section 28*d* such that an opening, such as 38, is created along horizontal bottom rack 36. As a result thereof, cable 12 of clothing lock 1 used in conjunction with garment 40 may pass through opening 38 and be positioned on top of a horizontal member 32*b* of inverted T-shaped section 28*d*. Inverted T-shaped section 28*c* may be returned to its closed position so as to secure garment 40 along horizontal bottom rack 36 between adjacent vertical members, such as 30*a* and 30*b*. The procedure is similarly repeated if the retailer desires to remove garment 40 from the horizontal bottom rack 36. Again, an inverted T-shaped section, such as 28*c*, is rotated or moved to its open position such that its horizontal member, such as 32*a*, is angularly displaced from an adjacent horizontal member, such as 32*b*. In this position, the garment 40 may be removed from horizontal bottom rack 36 by cable 12 being passed through opening 38.

While the present invention has been particularly shown and described with reference to a preferred embodiment, it will be readily appreciated by those of ordinary skill in the art that various changes and modifications may be made without departing from the spirit and scope of the invention. For instance, other less expensive articles or garments may be positioned along horizontal bottom rack 36 without the necessity of using the security lock 10 disclosed herein. It is intended that the appended claims be interpreted as including the foregoing as well as various other changes and modifications.

We claim:

1. A security device for a garment comprising a lock, a lock pin for said lock and a cable secured at one end to said lock, said cable having a free end including said lock pin, said lock pin consisting of a stiff metal needle having a tapered point for piercing a garment, said needle including a catch recess formed therein for forming the shaft of the lock and being adapted to be inserted into the lock to act as a lock pin.

2. The security device as set forth in claim 1 wherein the needle piercing the garment is wrapped around a garment support member and then is repierced through the garment for subsequent engagement in the block.

3. A security device as defined in claim 1 including means for removably mounting the lock in a garment.

4. A double bar coat rack upon which a plurality of garments may be engagably mounted comprising:

a stationary top bar;

a plurality of inverted T-shaped sections extending downwardly from the top bar, each inverted T-shaped section having a vertical member and a horizontal member, the horizontal members of each inverted T-shaped section may form a horizontal bottom rack, each said inverted T-shaped section being movable between an open position wherein a cable of a security device fixedly secured to the garment may be inserted onto and removed from the horizontal support bar through an opening, and a closed position, wherein the cable of the security device secures the garment on the horizontal bottom rack between adjacent vertical members of adjacent inverted T-shaped sections.

5. The double bar coat rack as set forth in claim 4 wherein the vertical members of the inverted T-shaped members restrain lateral movement of the garment along the horizontal bottom rack.

6. The double bar coat rack as set forth in claim 4 and further including a security lock which can be placed in the garment and includes a base from which the cable extends, the cable having a free end which is formed as a stiff metal pin which pierces the garment and is wrapped around the horizontal support pole, and subsequently repierces the garment for engagement in the base such that the garment is securely mounted on the horizontal bottom rack.

* * * * *